United States Patent [19]

Osborne, Sr.

[11] Patent Number: 4,819,762

[45] Date of Patent: Apr. 11, 1989

[54] FOLDING THREE LEGGED SAWHORSE

[76] Inventor: William R. Osborne, Sr., 65 Mill St., Binghamton, N.Y. 13900

[21] Appl. No.: 178,591

[22] Filed: Apr. 7, 1988

[51] Int. Cl.[4] ..... B27B 21/06; B25H 1/06

[52] U.S. Cl. ..... 182/153; 182/181; 182/225

[58] Field of Search ..... 182/153, 181–186, 182/225

[56] References Cited

U.S. PATENT DOCUMENTS

| | | | |
|---|---|---|---|
| 274,365 | 6/1984 | Lipinski . | |
| 293,847 | 2/1884 | Bremer . | |
| 659,979 | 7/1900 | Miller . | |
| 861,583 | 7/1907 | Foster | 182/176 |
| 4,105,091 | 8/1978 | Mahan . | |
| 4,181,292 | 1/1980 | Hubel . | |

FOREIGN PATENT DOCUMENTS

| | | | |
|---|---|---|---|
| 18743 | of 1891 | United Kingdom | 182/153 |

*Primary Examiner*—Reinaldo P. Machado

*Attorney, Agent, or Firm*—Ralph R. Barnard

[57] ABSTRACT

A folding three legged sawhorse suitable for use alone or in combination with another of the same is disclosed. A first horizontal beam is supported by a leg at each end. A second horizontal beam is hinged near the midpoint of the first horizontal beam and supported by a leg at its outer end. The second horizontal beam may be moved from a ready to use position which is substantially perpendicular to the first beam to a storage or transportation position which is parallel to the first beam. A spring attached to the underside of both the first beam and the second beam cooperates with the hinge and is tensioned for the dual purposes of locking the second beam in its folded position for storage and holding it in its open perpendicular position during use.

3 Claims, 1 Drawing Sheet

FOLDING THREE LEGGED SAWHORSE

BACKGROUND OF THE INVENTION

Sawhorses have long been used as portable structures for supporting building materials. Traditional sawhorses are difficult to transport or store because of their awkward proportions and construction. Moreover, sawhorses generally need to be used in pairs in order to support a piece of lumber in two places for cutting, for example.

It is an object of the present invention to provide a folding three legged sawhorse which is easily stored and transported, but which remains sturdy during use.

It is another object of the present invention to provide a sawhorse which is suitable for use alone or in combination with another of the same.

SUMMARY OF THE INVENTION

The present invention is a folding three legged sawhorse. Unlike the single beamed conventional sawhorse, the inventive sawhorse described herein has a second horizontal beam attached perpendicularly to the midpoint of the first horizontal beam and supported by a third leg. The second horizontal beam enables the user to support a workpiece in two places. Therefore, the inventive sawhorse may be used by itself, because the additional support traditionally provided by a second sawhorse is not needed.

Furthermore, the second horizontal beam is hinged to the first so that it may be folded to a position parallel to the first beam. In this position, the present invention is ready for storage or transportation. A spring is tensioned for the dual purposes of locking the second beam in its folded position and holding it in its open perpendicular position during use.

DESCRIPTION OF THE PREFERRED EMBODIMENT

The present invention is best explained by reference to the drawings. The numerals refer to the same part in each of the drawings.

Figure 1:
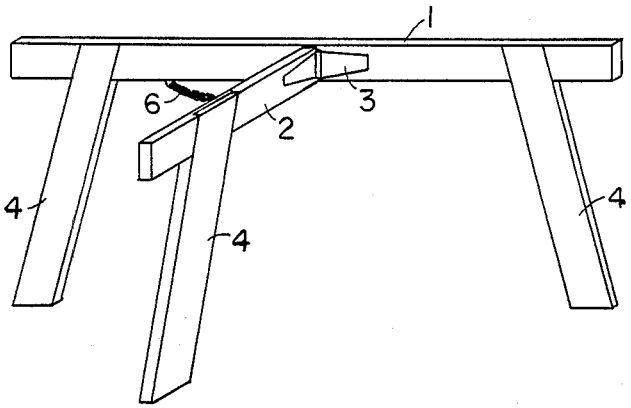
FIG. 1 is a perspective view of the three legged sawhorse set up in an open and ready to use position.

Referring now to FIG. 1, the three legged sawhorse is shown in a position ready to be used. A first horizontal beam (1) is supported near to each of its outer ends upon a vertical support member or leg (4). A second horizontal beam (2) is connected near the midpoint of the first beam (1) by a hinge (3). The hinge (3) is located at a distance below the surface of the horizontal beams (1 and 2) in such a manner that will prevent the destruction of tools that accidentally pierce the sawhorse at the point where it is attached.

The second beam (2) is supported by a vertical support member or leg (4) near its outer end. Spring (6) is attached to the underside of both the first beam (1) and the second beam (2). It cooperates with hinge (3) and is tensioned such that the second beam (2) is held in an open position substantially perpendicular to the first beam (1) during use. The force of the spring (6) keeps the second beam (2) extended. The second beam (2) is prevented from moving to an angle greater than 90 degrees because its hinge end abuts against the flat side of the first beam (1).

Spring (6) also works in combination with hinge (3) to lock the second beam (2) in a position parallel to the first beam (1) during storage or transportation. While it requires force to move the second beam (2) from its open substantially perpendicular position to its parallel position, once it reaches the parallel position it is held by the spring (6) without being tied to the first beam (1).

The legs (4) may be joined to the horizontal beams (1 and 2) by any method which ensures the stability of the sawhorse. It is preferable that the joint be one which becomes stronger as pressure is exerted upon it, such as a rabbet joint (as illustrated) or a mortise and tenon. Greater stability is provided by slanting all three legs (4) away from the center of the sawhorse. Additionally, the legs (4) should slant back from the horizontal beams (1 and 2). In one instance the inventor has found that sufficient stability is created by placing 29" long legs (4) at a distance of four inches from the extremity of the horizontal beams (1 and 2) and slanting them nine degrees out and two degrees back such that the bottom of the legs line up directly under the end of the horizontal beam (1 or 2) which they support. It should be clear that the legs (4) could be made any length needed to a special project, but a length of 29" would serve many purposes.

Figure 2:
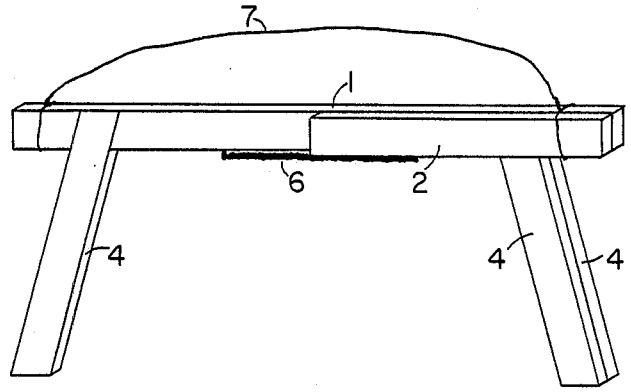
FIG. 2 illustrates the inventive sawhorse in a folded nonuse position ready for storage or transportation.

Referring now to FIG. 2, the inventive sawhorse is shown in its closed position ready for storage or transportation. The second beam (2) and attached leg (4) lay parallel against both the first beam (1) and one of its legs (4). The sawhorse is locked to stay in this position by the tension created from spring (6). A rope (7) or similar material may be used to aid in carrying or hanging the sawhorse, but it is not essential to the invention. The folding aspect of the present invention is a great improvement over traditional sawhorses which are difficult to store and transport because of their awkward proportions and construction.

Figure 3:
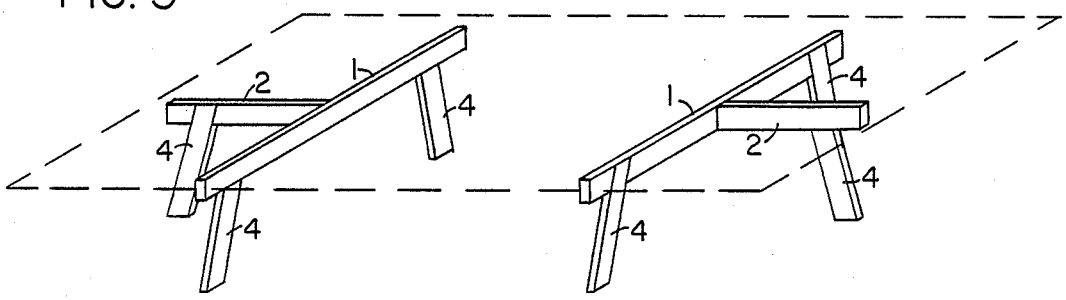
FIG. 3 is a perspective view of two of the inventive sawhorses set up together to create a larger work area.

As illustrated in FIG. 3, the sawhorse may be used in combination with another of the same to provide a greater work surface. The second beam (2) of each of the sawhorses may point away from the other (as shown) or toward the other. Because a second beam (2) is utilized in the present invention, supported by leg (4), it is not necessary to use a second sawhorse, as traditionally required. The first and second horizontal beams (1 and 2) of the inventive sawhorse together form the support traditionally only possible by the use of two sawhorses. For example, a material that needs to be supported for sawing, cutting, drilling, etc. may be laid across the tops of the first and second beams (1 and 2), creating support in two places.

Although I have herein shown and described only one preferred embodiment of my invention, it will be apparent to those skilled in the art to which the invention appertains, that various other changes and modifications may be made to the subject invention without departing from the spirit and scope thereof, and therefore it is to be understood that all modification, variations and equivalents within the spirit and scope of the subject invention are herein meant to be encompassed in the appended claims.

I claim:

1. Sawhorse type support means suitable for use alone or in combination with another of the same, comprising:

(a) a first horizontal beam;

(b) a second horizontal beam;

(c) hinge means for connecting said second horizontal beam at an angle substantially perpendicular near the midpoint of said first horizontal beam;

(d) three vertical support members;

(e) means for joining said vertical support members to said horizontal beams;

(f) said hinge means including a hinge pin for connecting said second horizontal beam to said first horizontal beam near its midpoint, whereby said second horizontal beam can fold from its open substantially perpendicular position to a closed position parallel to said first horizontal beam;

(g) a spring means being attached by one end to the underside of said first horizontal beam and by the other end to the underside of said second horizontal beam;

(h) said spring being tensioned in a direction and position on one side of the hinge pin to hold said second horizontal beam in its open perpendicular position during use and said spring being tensioned in a direction and position on the other side of said hinge pin to lock said second horizontal beam in its closed position parallel to said first horizontal beam.

2. The sawhorse recited in claim 1, wherein said vertical support members are slanted away from the center of the sawhorse to provide greater stability.

3. The sawhorse recited in claim 1, wherein said join means is a mortis and tenon.

* * * * *